US008550271B2

(12) United States Patent
Merino Caballero

(10) Patent No.: US 8,550,271 B2
(45) Date of Patent: Oct. 8, 2013

(54) LOW GAUGE CROWN CAP

(75) Inventor: Alfredo Merino Caballero, Lima (PE)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 13/585,303

(22) Filed: Aug. 14, 2012

(65) Prior Publication Data

US 2012/0305520 A1 Dec. 6, 2012

Related U.S. Application Data

(63) Continuation of application No. 12/597,385, filed as application No. PCT/US2008/069193 on Jul. 3, 2008, now abandoned.

(30) Foreign Application Priority Data

Jul. 6, 2007 (PE) ..... 000728-2007/OIN

(51) Int. Cl.
*B65D 41/00* (2006.01)

(52) U.S. Cl.
USPC ..... 215/328; 215/324; 215/327

(58) Field of Classification Search
USPC ..... 215/319, 328, 327, 324, 303, 304, 329; 220/309.1, 310.1; 29/592
See application file for complete search history.

(56) References Cited

U.S. PATENT DOCUMENTS

| | | | | |
|---|---|---|---|---|
| 2,048,062 A | | 7/1936 | Elder | |
| 2,233,904 A | | 3/1941 | Wagner | |
| 2,829,790 A | | 4/1958 | Isele-Aregger | |
| 3,450,291 A | * | 6/1969 | Lovell | 215/305 |
| 4,372,457 A | | 2/1983 | Kunimoto et al. | |

FOREIGN PATENT DOCUMENTS

| | | |
|---|---|---|
| DE | 886859 | 8/1949 |
| EP | 1238917 | 9/2002 |
| FR | 322592 | 6/1902 |
| GB | 924892 | 5/1958 |
| WO | WO 2009/009429 | 1/2009 |

OTHER PUBLICATIONS

English Translation of Mexican Application No. MX/a/2010/000253: Office Action dated Sep. 19, 2011, 4 pages.
Mexican Application No. MX/a/2010/000253: Office Action dated Sep. 19, 2011, 4 pages.

* cited by examiner

*Primary Examiner* — J. Gregory Pickett
*Assistant Examiner* — Ernesto Grano
(74) *Attorney, Agent, or Firm* — Woodcock Washburn LLP

(57) ABSTRACT

A crown cap that may use less steel than a conventional crown cap is disclosed. A crown cap comprises a shell formed of an increased hardness, including a peripheral skirt, a round panel integrally formed with the skirt, the panel including one to three radially symmetric grooves formed therein, each groove spaced apart from a contact portion of the panel that is adapted for contacting the rim of a bottle upon application of the crown cap onto the bottle, and a liner located on the underside of the panel. The radially symmetric grooves may be circular.

20 Claims, 9 Drawing Sheets

LOW GAUGE CROWN CAP

CROSS-REFERENCE TO RELATED APPLICATIONS

This application is a Continuation of U.S. patent application Ser. No. 12/597,385, filed Aug. 3, 2010, now abandoned which claims priority to the National Stage of International Application No. PCT/US2008/069193, filed Jul. 3, 2008, which claims the benefit to Peru Patent Application No. 000728-2007/OIN, filed Jul. 6, 2007, the disclosures of which are incorporated herein by reference in their entirety.

TECHNICAL FIELD

The technology relates to closures for containers, and more particularly to a fluted crown cap for sealing a bottle or container opening.

BACKGROUND

The bottle cap was first patented and produced in the 1890's. The basic metal crown cap has not conceptually changed from that time. Conventional crown caps include a circular top, a circular skirt depending downwardly from a periphery of the top, and a downwardly and radially outwardly extending flange extending from a periphery of the skirt. The flange is fluted or serrated, and may be configured for either pry-off or twist off removal. Upon application of the cap to a bottle, the flutes are deformed to affix the cap to a bead or threads on the bottle's finish, and a thermoformed liner on the underside of the cap is pressed against the bottle's rim to enhance sealing.

The majority of crown caps used in the U.S. are twist off types that operate on new bottles that are not recycled. The majority of crown caps in many countries, however, are pry-off types that often operate on recycled bottles.

There is a general need for improved and lower weight crown caps.

SUMMARY

A lightweight, crimp-type crown cap for application to a glass beverage bottle, comprises a shell and a liner. The shell is formed of a material comprising steel having an average hardness of greater than 62 on the 30T scale. The shell includes a panel and a peripheral skirt having flutes downwardly depending therefrom, such that the flutes are capable of being crimped to affix the crown cap to a bottle. The panel is integrally formed with the skirt and includes structural features formed as recesses therein. The liner is located on the underside of the panel, and includes at least one groove.

Preferably, the structural features are one to three circular grooves, and may also be a single groove, at least one of a star, a cross, one or more circular grooves, and dimples. The grooves may be spaced apart from a contact portion of the panel such that the contact portion adapted for contacting the rim of a bottle upon application of the crown cap onto the bottle. The outermost groove may be aligned to the rim of a conventional bottle upon application of the crown cap to the bottle. Preferably the structure is recessed relative to the panel.

Preferably, the shell has a hardness of greater than about 65, more preferably greater than about 68, more preferably, greater than about 71, and most preferably approximately 73, and may be formed of double reduced plate.

A combination bottle and crown cap is also provided.

A method of crimping a crown cap onto a glass bottle, comprising the steps of providing a crown cap as described above, positioning the crown cap onto a rim of a bottle, and moving a crimping tool downwardly relative to the crown cap such that the crimping tool initially contacts the crown cap only at the flutes approximately at the outer edge thereof.

DETAILED DESCRIPTION OF ILLUSTRATIVE EMBODIMENTS

Figure 1:
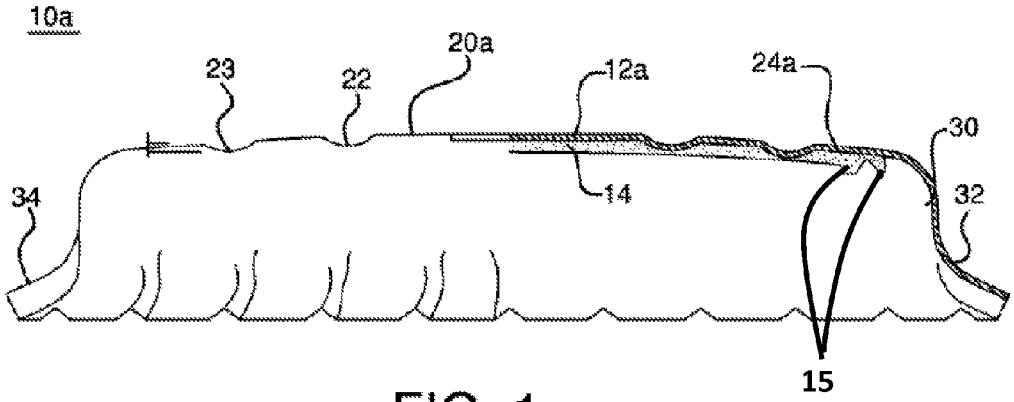
FIG. 1 is a partial cutaway side view depicting a crown cap embodying aspects of the present invention.
Figure 2A:
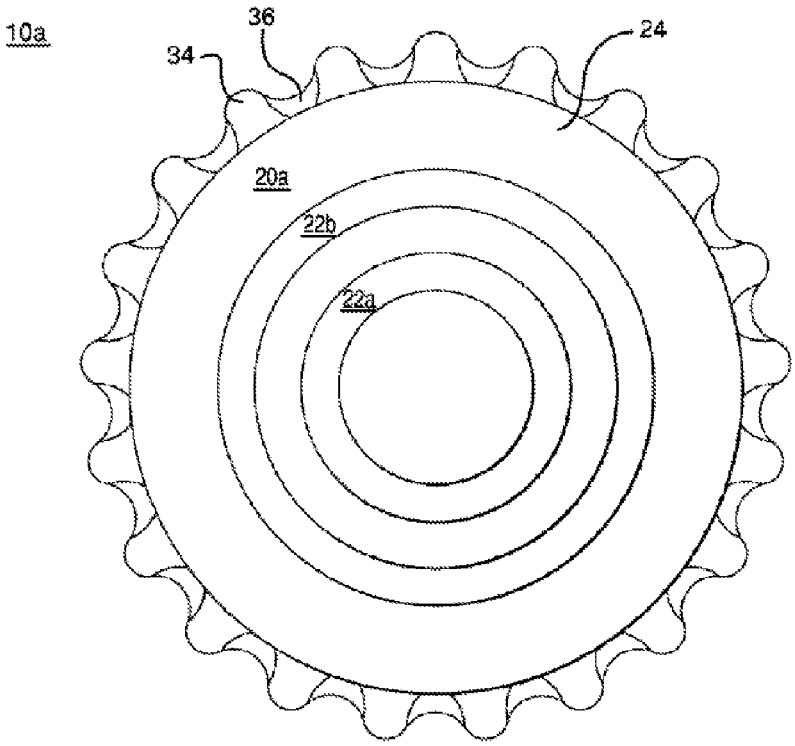
FIG. 2A is a top plan view of the crown cap depicted in FIG. 1.

Referring to FIGS. 1 and 2A to illustrate the structure and function of an embodiment of the present invention, a crown cap 10*a* includes a shell 12*a* and a liner 14. Shell 12*a* includes a circular panel 20*a*, a skirt 30, and a flange 32. Skirt 30 downwardly extends from a periphery of panel 20*a*. Flange 32 obliquely extends from skirt 30. Alternating flutes 34 and lands 36 are formed on a circumferential portion of skirt 30. Shell 12*a*, and other shells shown in the figures, is shown as a pry-off type that is opened with a lever. The present invention also encompasses a twist-off type (not shown in the figures) that is opened by twisting, as will be understood by persons familiar with crown cap technology.

Panel 20*a* has two circular grooves 22 and 23 that are concentric about a vertical center of cap 10*a*. Outside of the outermost groove 23, panel 20*a* includes a contact portion 24*a* that is adapted for contacting the rim of a bottle upon application of the crown cap 10*a* onto the bottle. Preferably, in its as-manufactured state as shown in FIGS. 1 and 2A, contact portion 24*a* is relatively flat or has approximately the same curvature as most of the remainder of the panel 20*a*.

Each of grooves 22 and 23 preferably has an inwardly curved profile in cross section, as best shown in FIG. 1, such that they function as ribs or structural reinforcements that, the inventors surmise, help to stiffen panel 20*a* against deflection or deformation.

Figure 2B:
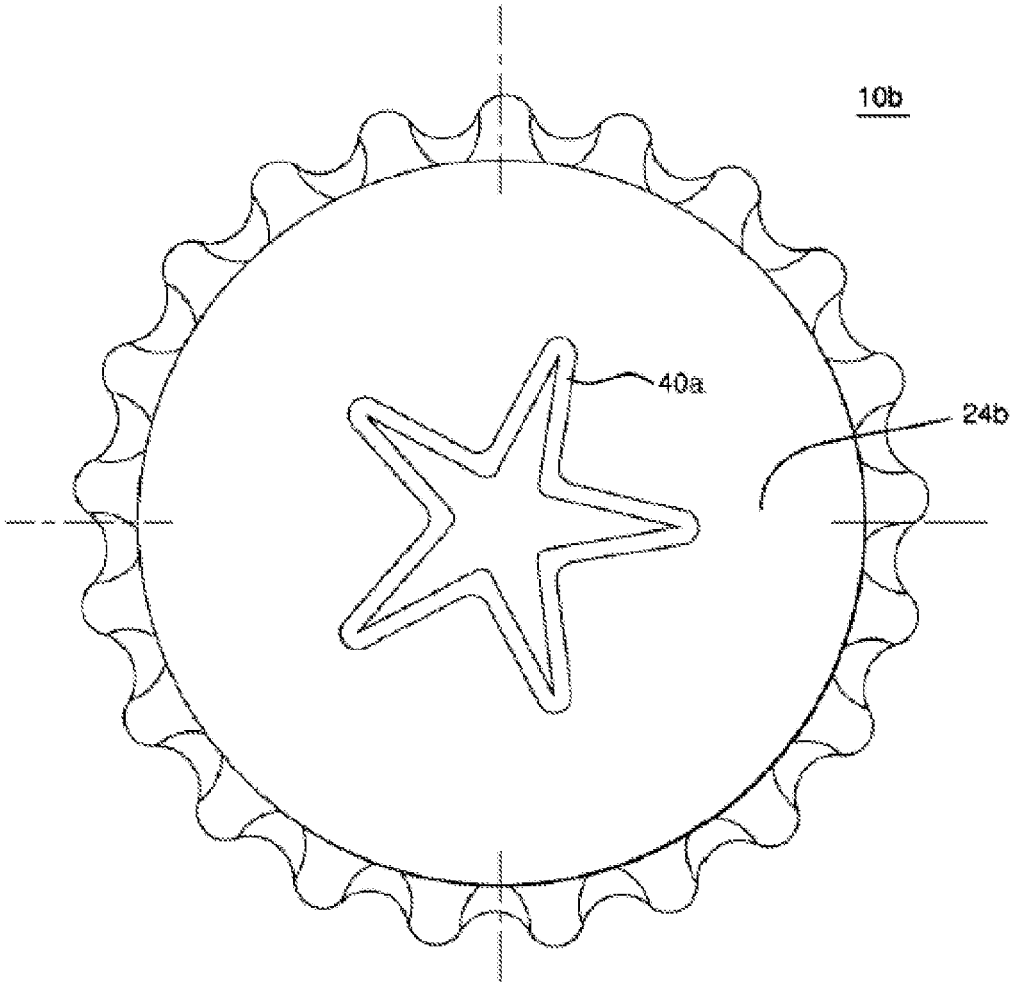
FIG. 2B is a top plan view of another embodiment of a crown cap having reinforcement in the shape of a 5 sided star.
Figure 2C:
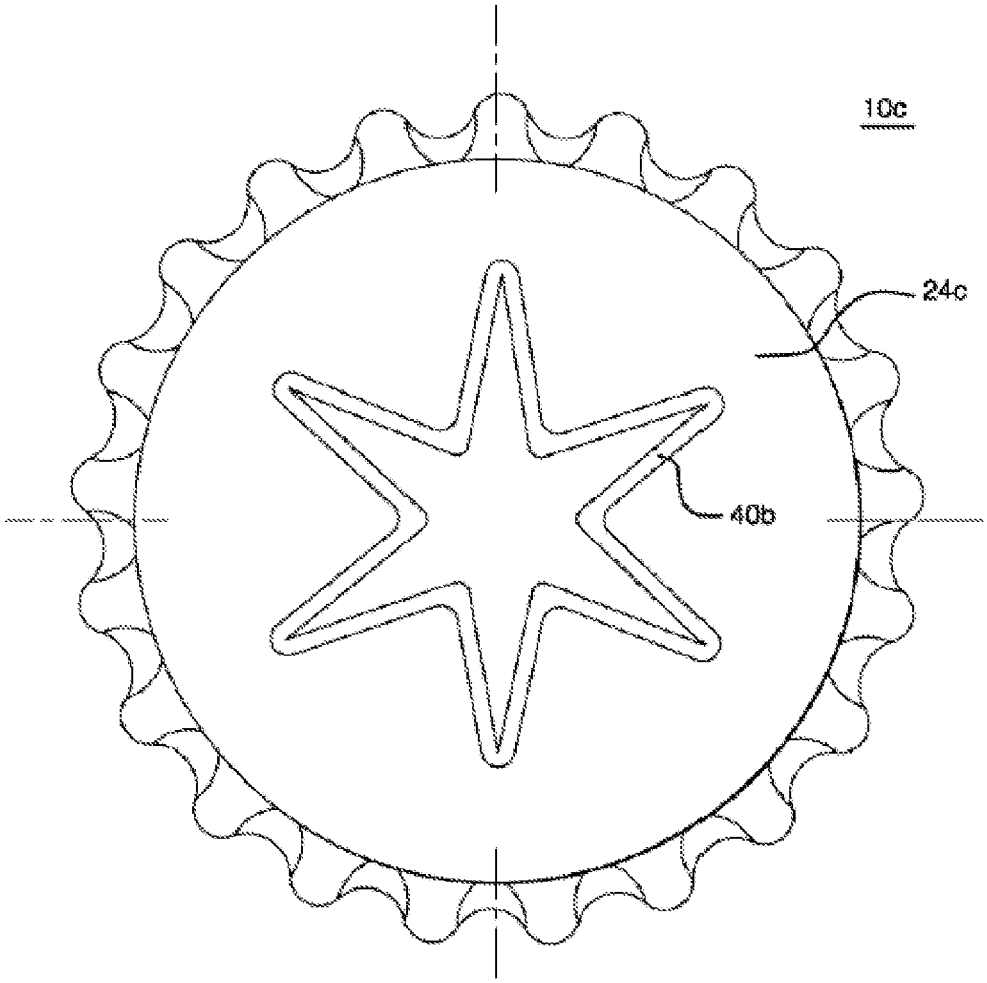
FIG. 2C is a top plan view of another embodiment of a crown cap having reinforcement in the shape of a 6 sided star.
Figure 2D:
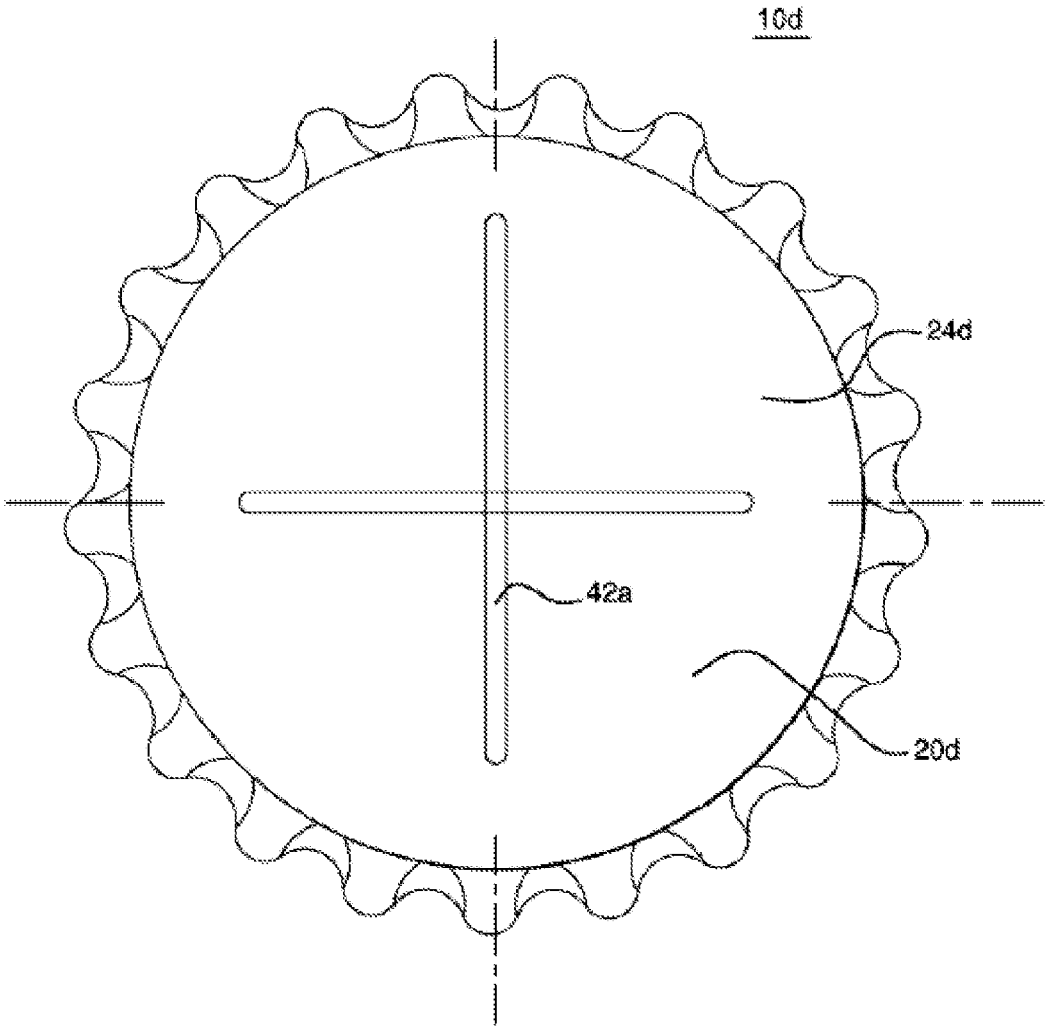
FIG. 2D is a top plan view of another embodiment of a crown cap having reinforcement in the shape of a two-line cross.
Figure 2E:
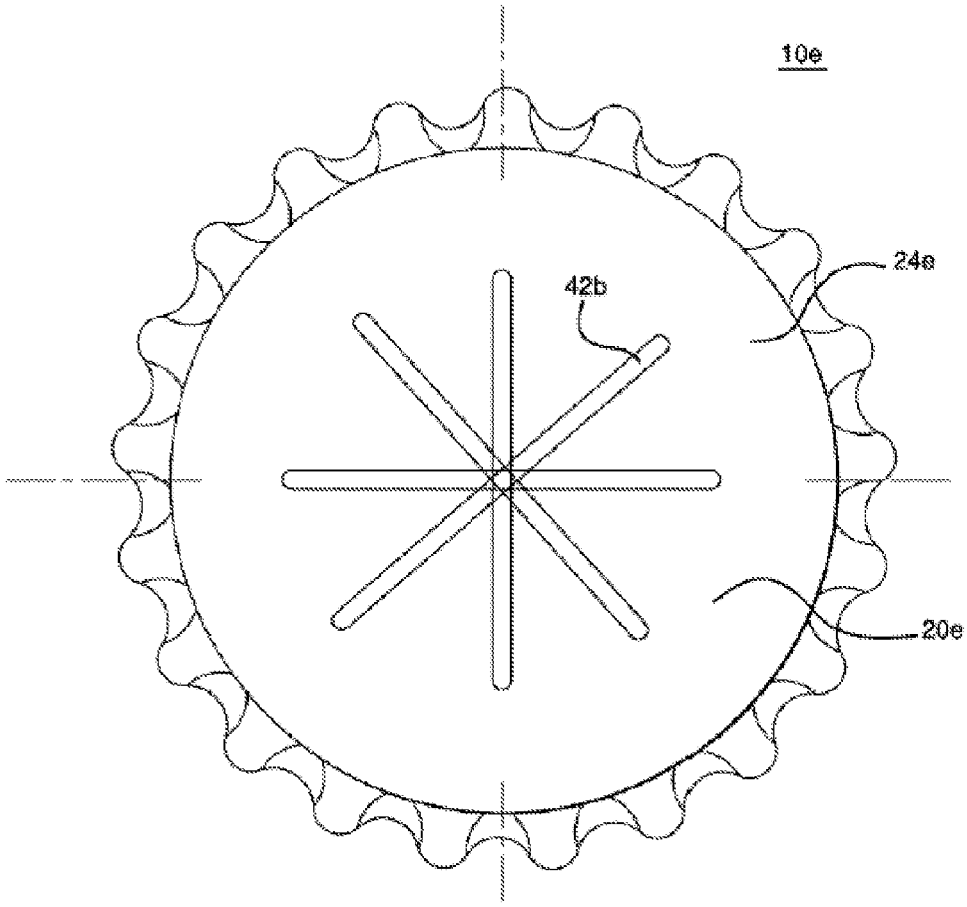
FIG. 2E is a top plan view of another embodiment of a crown cap having reinforcement in the shape of a four-line cross.
Figure 2F:
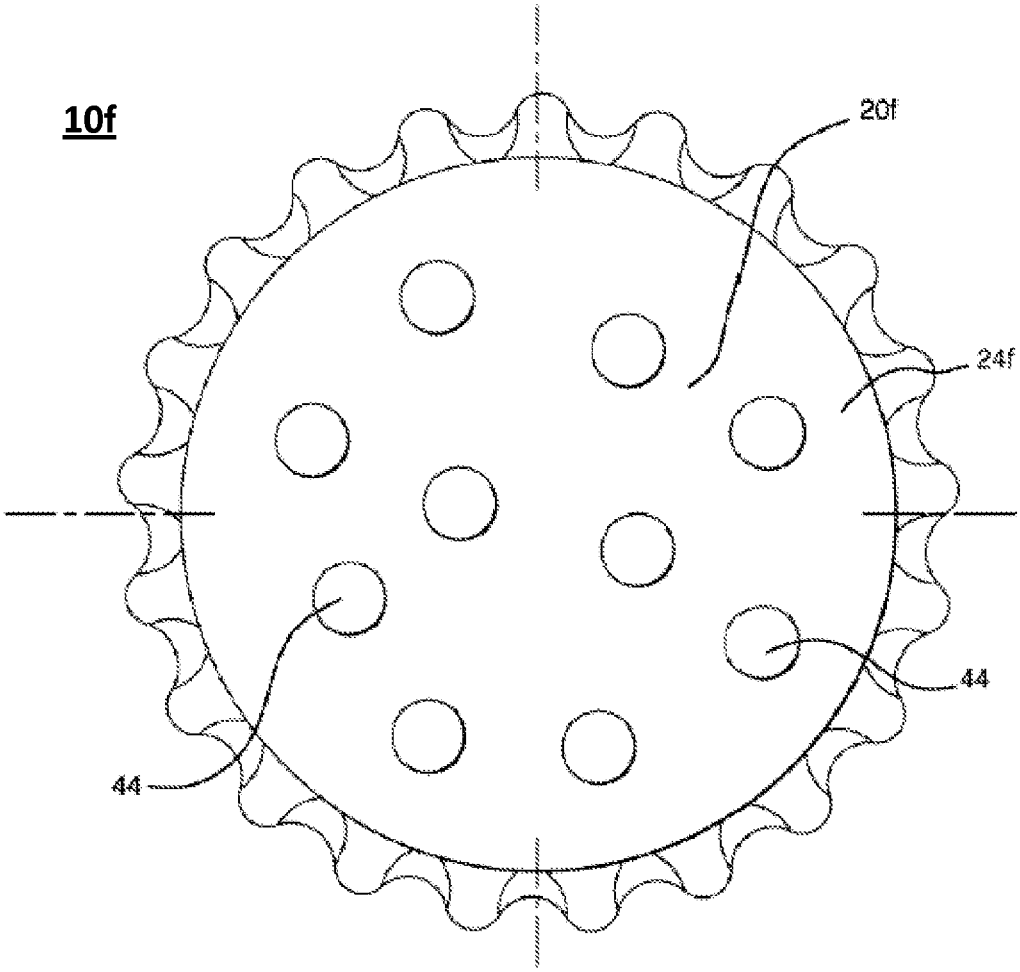
FIG. 2F is a top plan view of another embodiment of a crown cap having reinforcement in the shape of plural dimples.
Figure 2G:
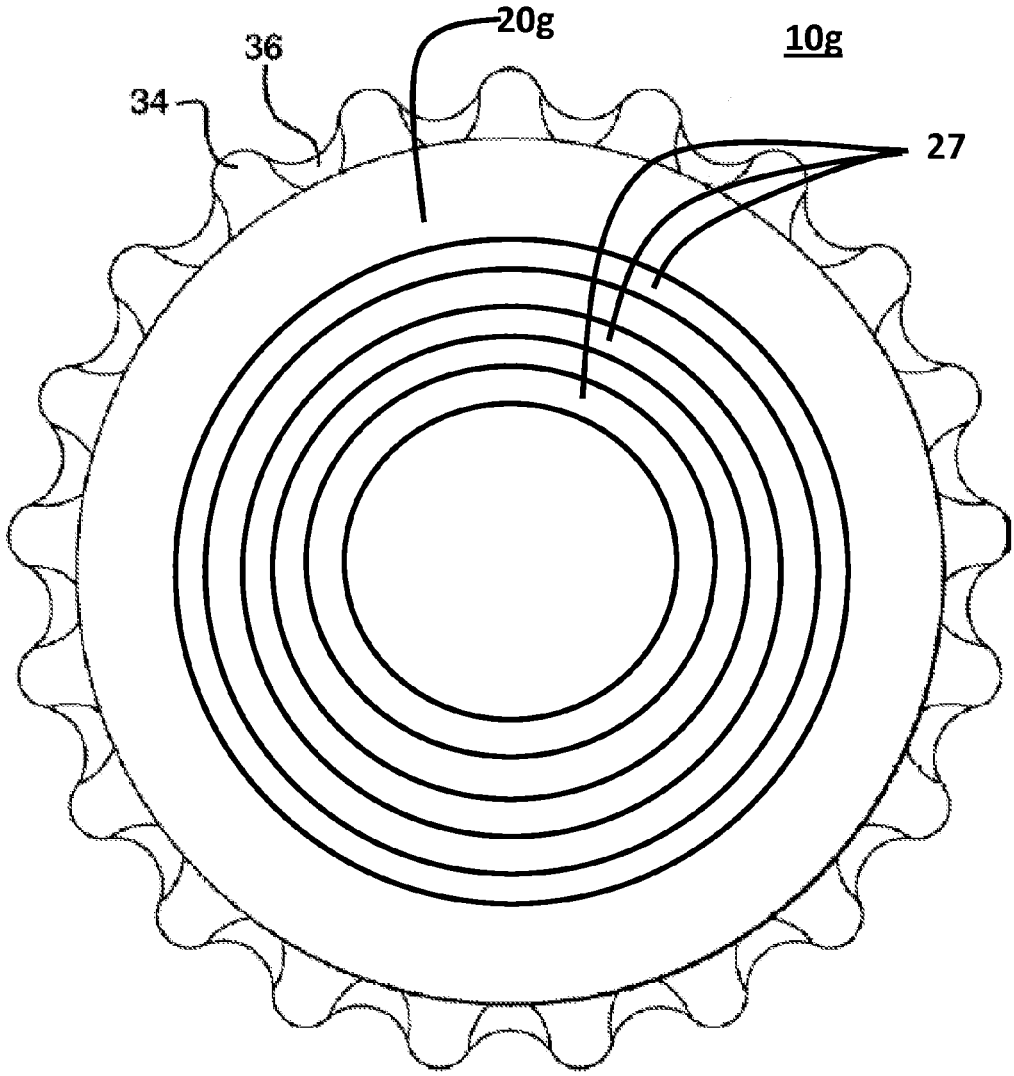
FIG. 2G is a top plan view of another embodiment of a crown cap having reinforcement in the shape of a plurality of rings.

The present invention also encompasses other structural features in the panel, such as stars, crosses, dimples, and the like. For example, FIGS. 2B through 2G illustrate crowns 10*b* through 10*g* for examples of other structural features that may be employed. FIGS. 2B and 2C illustrate a five sided star 40*a* and a six sided star 40*b*, and FIGS. 2D and 2E illustrate a cross 42*a* formed by two lines and a cross 42*b* formed by four lines. FIG. 2F illustrates reinforcements formed by dimples 44. FIG. 2G illustrates three grooves 27 formed as structural features in panel 20*g*. Preferably, the reinforcements, such as stars 40*a* and 40*b* and crosses 42*a* and 42*b*, are radially symmetrical. The present invention encompasses structure that is not symmetrical, such as interlocking grooves (now shown in the figures). Preferably, the structure (such as grooves, stars, crosses, dimples, and the like) formed in the panels is recessed (that is, protrude downwardly) relative to the remainder of the panel. The quantity, shape, and disposition of the grooves, stars, crosses, dimples and other structure may be determined by the specific performance requirements of the crown cap, as well as its thickness, strength, ductility, intended use, and the like, which will be apparent to persons familiar with crown cap technology in light of the present disclosure.

Preferably, the outermost rib 23 of first embodiment 10*a* and the structures 40*a*, 40*b*, 42*a*, 42*b*, and 44 are configured to provide corresponding contact portions 24*a* through 24*g*, each of which preferably is relatively flat or has approximately the same curvature as most of the remainder of the panel 20*a* through 24*g*. In each of the figures, the contact portions 24 are located outboard of the structure 23, 40*a*, 40*b*, 42*a*, 42*b*, or 44 to provide a uniform surface (that is substantially unbeaded) on which liner 14 and the bottle rim is aligned with such that liner 14 is located between contact portion 24*a* (or 24*b* through 24*g*) and preferably deformed or squeezed in a gap therebetween. Accordingly, the shape of the contact portions 24*a* through 24*g* preferably does not significantly change during the application process (including crimping) such that its shape before crimping is substantially the same as after crimping. The present invention is not limited to this configuration of any of the contact portions 24, but rather the scope of the invention is defined in the claims.

Skirt 30 smoothly merges into downwardly and radially outwardly extending flange 32. The skirt 30 and flange 32 are preferably adapted to be crimped onto the neck of a bottle for sealing The flange 32 is divided into undulating, repeating portions that define the flutes 34 and lands 36. Preferably, the repeating portions are circumferentially evenly spaced apart such that each flute 34 is identical to all other flutes 34 around the circumference of the crown cap 10, and each land 36 is identical to all other lands 36 around the circumference of the crown cap 10. While the crown cap 10 is shown as having twenty-one flutes 34 and lands 36, it should be understood that the crown cap 10 may include any number of flutes 34 and lands 36.

Figure 3A:
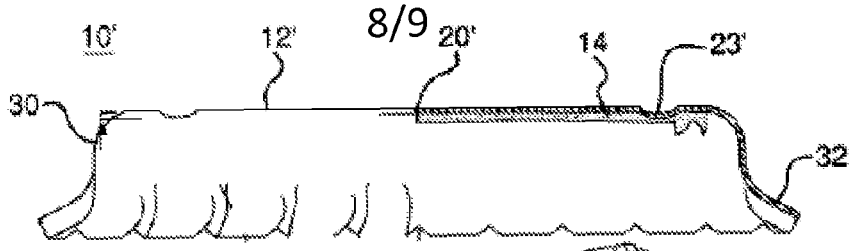
FIG. 3A is a partial cutaway side view depicting a embodiment of a crown cap embodying aspects of the present invention.
Figure 3C:
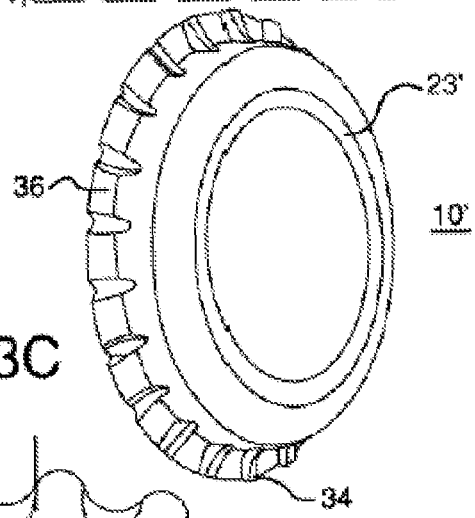
FIG. 3C is a perspective view of the embodiment of FIG. 3A.
Figure 3B:
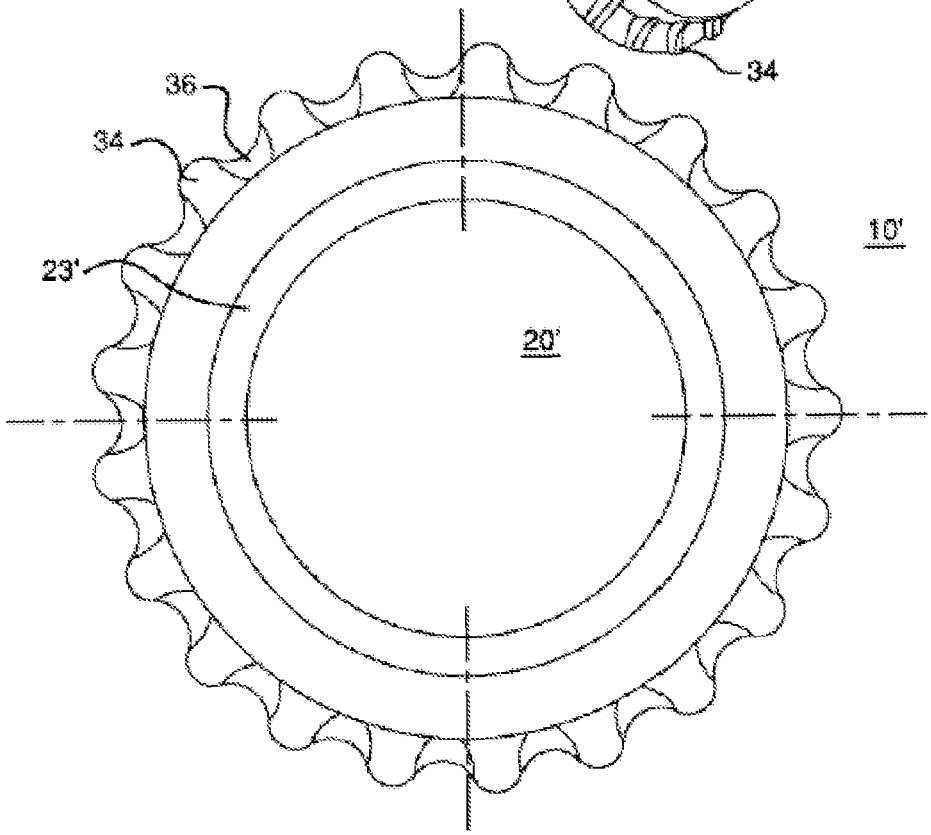
FIG. 3B is a top plan view of the crown cap depicted in FIG. 3A.

Referring to FIGS. 3A, 3B, and 3C to illustrate a second embodiment of the present invention, a crown cap 10' includes a shell 12' and a liner 14. Shell 12' includes a circular panel 20', a skirt 30, and a flange 32. Skirt 30 and flange 32 are as described above with respect to first cap embodiment 10*a*.

Panel 20' has a single circular groove 23' that has a center on the vertical center of cap 10'. Groove 23' has a greater diameter than does groove 23 of the first embodiment (for a given crown diameter) such that groove 23' is located over the bottle rim when applied, as explained more fully below. The embodiments of crown cap 10*a* is illustrated with two grooves 22 and 23 and crown cap 10' is illustrated with one groove 23'. The present invention also encompasses any number of grooves, especially between one and three.

Liner 14 will be described with respect to first embodiment crown cap 10*a*, and the present description of liner 14 applies equally to liner 14 shown with respect to embodiment crown cap 10'. Liner 14 is disposed on the underside of panel 20*a*. After crimping, liner 14 contacts and seals against the rim of a bottle. Liner 14 as illustrated in FIG. 1 is a conventional, thermoformed, dual lip or bead liner that is available from SACMI IMOLA, as will be understood by persons familiar with crown cap technology. The present invention is not limited to the choice or presence of a liner, and encompasses other liner configurations, such as a conventional, single bead liner (not shown in the figures), as well as other materials, such as PVC and conventional PVC substitutes. Liner 14 includes beads 15, comprising an inboard and outboard lip for contact with an inboard and outboard portion of the bottle. The bead of a single bead liner preferably engages the inboard portion or corner region of the bottle rim.

After any one of shells, which are generally referred to by reference numeral 12 is formed, and liner 14 is pressed into its underside, shell 12 is placed on a bottle finish such that the contact portion 24 is aligned with at least a portion of the rim of the bottle. Flutes 34 are crimpled or deformed about features of the bottle finish to affixed crown cap 10 to the bottle. Accordingly, upon crimping, liner 14 contacts bottle rim and seals in a conventional manner.

Figure 4:
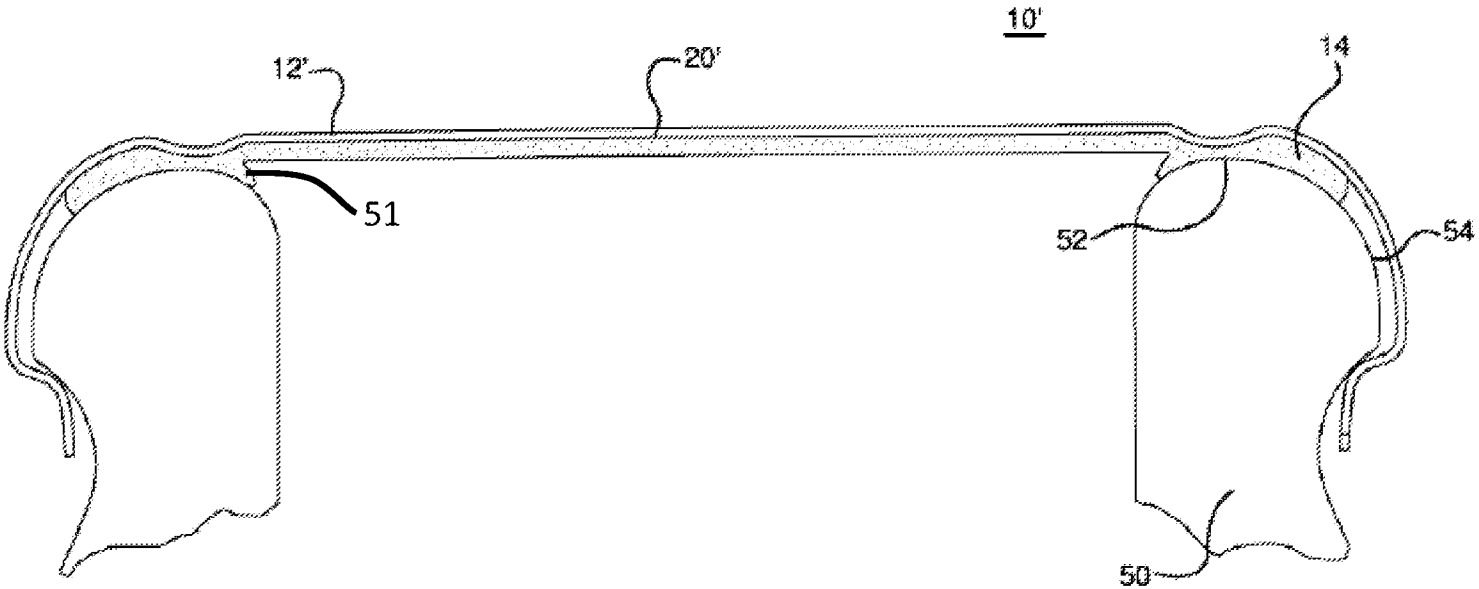
FIG. 4 is a cross sectional view of the crown cap depicted in FIG. 1B crimped onto a bottle.

Referring to FIG. 4 to describe the application of second embodiment shell 12' to a bottle 50 having a rim 52 and a bead 54, after liner 14 is pressed into its underside, shell 12' is placed on a bottle finish such that groove 23' is located directly over the bottle rim 52. Upon crimping of flutes 34 relative to bead 54, liner 14 is squeezed between and deformed by the underside of groove 23' and rim 52 such that a single, plug-like lip 51 of the liner engages the innermost rim of the bottle 50. The crimping process for applying any of the shells described herein to a bottle (for either pry-off or twist-off types of shells) preferably is performed by a ring-like crimping tool that contacts the outer edge or edge region of the flange 32, thereby avoiding or diminished scuffing or marring of flange 32 and diminishing force applied to bead 54.

The present invention also encompasses structure, such as single or multiple grooves, that is located near or aligned with the inboard rim or edge of a bottle, such as bottle 50. In such a configuration, the underside of the structure may aid in compressing or deforming the liner against the inboard edge or rim of the bottle (not shown in the Figures).

The crown caps 10*a* through 10*f* and 10' (referred to generally by reference numeral 10) preferably are formed with steel of increased hardness compared with conventional crown caps presently in commercial production. For example, conventional crown caps are often formed of single reduced, T4, tinplate having a thickness of from 0.21 mm to 0.23 mm. Such tinplate has an average hardness (that is, the reported hardness value regardless of +/− variations) of approximately 61 on a 30T hardness scale, in accordance with ASTM 623. Crown caps 10 described herein may be made thinner and lighter weight compared with the prior art, for example, crown caps 10 may be formed of a material having a thickness of about 0.16 mm to 0.18 mm that have the same or roughly equal performance as conventional, thicker caps. These decreases in metal usage are more easily achieved when the structure of crown caps 10 are made with steel having increased hardness. For example, the inventor has demonstrated the effectiveness of low gauge crowns having grooves using DR8 (according to ASTM 623) or DR550

(according to EN 10203). Optionally, the inventor surmises that other materials may be used, such as single reduced tinplate or like material having enhance tempering, tin-free steel having similar properties as those described herein, and the like.

The crown caps 10 preferably have an average hardness of greater than 62 on the 30T scale (conforming to ASTM 623), more preferably greater than about 65, more preferably greater than about 68, more preferably greater than about 71. The embodiments shown in FIG. 1 and FIG. 3A were demonstrated to be effective using steel having a hardness of 73. The upper limit of hardness is set by the maximum stress acceptable to the glass bottle during the crimping process or the spring back (which may tend to urge the crimped flanges toward an uncrimped state) associated with harder plate.

The crown caps 10 may be formed with conventional press equipment, with only minor changes to parts of the tooling to form the structure (such as the grooves, crosses, stars, and dimples). And crown caps 10 may be crimped with conventional equipment, only modified to have a smaller throat compared with existing, conventional crimpers.

Because hardness has a relationship to strength as reflected in the yield point, the aspect of the hardness of the crown may be expressed in yield point on a corresponding scale. For example, DR8 or DR550 tinplate may has a yield point (in a tensile test) of 550 MPA. The inventor believes that the most advantageous crown cap has a combination of one or more of the structured described herein and harder plate as described herein. The present invention, however, is stated in the claims and the present invention encompasses crown caps that do not have all of the structure, materials, and/or advantages in this specification.

According to this description, commercially acceptable crown caps formed according to the present disclosure can be commercially made with up to 25 percent less steel compared with many conventional crown caps, which has corresponding advantages in carbon emissions. The savings in steel weight are approximately proportionate to the reduction in metal thickness. Further, even though energy required to cool an individual crown is tiny, the energy required to cool the total number of crowns produced each year (approximately 45 billion in North America and approximately 300 billion throughout the world), and the corresponding reduction in that energy, is significant.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims. Furthermore, any features of one described embodiment can be applicable to the other embodiments described herein.

What is claimed is:

1. A lightweight crown cap for application to a glass beverage bottle, comprising:

a shell formed of a material comprising steel having an average hardness of greater than 62 on the 30T scale, the shell including:

a peripheral skirt having, flutes downwardly depending therefrom, the flutes are capable of being crimped to affix the crown cap to a bottle; and a round panel integrally formed with the skirt, the panel including at least one recessed circular groove that has its center approximately at the longitudinal center of the panel; and a liner located on the underside of the panel.

2. The crown cap of claim 1, wherein the at least one recessed circular groove includes two or three recessed circular grooves.

3. The crown cap of claim 2, wherein each recessed circular groove is spaced apart from a contact portion of the panel that is adapted for contacting the rim of a bottle upon application of the crown cap onto the bottle.

4. The crown cap of claim 1, wherein a first groove of the at least one recessed circular groove has a diameter to align it to the rim of a conventional bottle upon application of the crown cap to the bottle.

5. The crown cap of claim 1, wherein the shell has a hardness of greater than about 65.

6. The crown cap of claim 1, wherein the shell has a hardness of greater than about 68.

7. The crown cap of claim 1, wherein the shell has a hardness of greater than about 71.

8. The crown cap of claim 1, wherein the shell has a hardness of approximately 73.

9. The crown cap of claim 1 wherein the shell is formed of double reduced plate.

10. The crown cap of claim 1, wherein the panel further comprises at least one of a star, a cross, and dimples.

11. The crown cap of claim 1, wherein the liner includes one or more beads that are compressible to enhance sealing.

12. A bottle and crown cap combination, comprising:

a bottle having a body and a neck extending up from the body, the top portion of the neck having a finish:

a lightweight crown shell formed of material comprising steel having an average hardness of greater than 62 on the 30T scale, the shell including:

a peripheral skirt having flutes downwardly depending therefrom, the flutes are crimped on the bottle finish to affix the crown cap to the bottle; and a round panel integrally formed with the skirt, the panel including one to three circular grooves formed therein; and a liner located on the underside of the panel.

13. The crown cap of claim 12, wherein each of the one to three grooves is radially symmetrical and concentric about a center of the panel.

14. The crown cap of claim 12, wherein the panel consists solely of a single circular groove that is has its center approximately at the longitudinal center of the panel.

15. The crown cap of claim 12, wherein each of the one to three grooves is recessed relative to the panel.

16. The crown cap of claim 12, wherein the liner includes a pair of concentric beads that engage the bottle.

17. The crown cap of claim 12, wherein the liner includes a single, plug-like lip that engages the innermost rim of the bottle.

18. The bottle and crown cap combination of claim 12, wherein the finish of the bottle is a pry-off finish.

19. The bottle and crown cap combination of claim 12, wherein the finish of the bottle is a twist-off finish.

20. A method of crimping a crown cap onto a glass bottle, comprising the steps of:

providing a lightweight crown cap that includes:

a shell formed of a metal having an average hardness of greater than 62 on the 30T scale, the shell including:

a peripheral skirt having flutes downwardly depending therefrom, the flutes capable of being crimped to affix the crown cap to a bottle; and a round panel integrally formed with the skirt, the panel including at least one recessed circular groove that has its center approximately at the longitudinal center of the panel; and the liner located on the underside of the panel;

positioning the crown cap onto a rim of a bottle; and moving a crimping tool downwardly relative to the crown cap, the crimping tool initially contacting the crown cap only on the flutes approximately at an outer edge of the crown cap.

* * * * *